US007278554B2

(12) United States Patent
Armstrong

(10) Patent No.: US 7,278,554 B2
(45) Date of Patent: Oct. 9, 2007

(54) HINGED DISPENSER HOUSING AND ADAPTOR

(75) Inventor: John B. Armstrong, Cincinnati, OH (US)

(73) Assignee: Chester Labs, Inc., Cincinnati, OH (US)

( * ) Notice: Subject to any disclaimer, the term of this patent is extended or adjusted under 35 U.S.C. 154(b) by 508 days.

(21) Appl. No.: 10/842,204

(22) Filed: May 10, 2004

(65) Prior Publication Data

US 2005/0247737 A1 Nov. 10, 2005

(51) Int. Cl.
*B65D 88/54* (2006.01)

(52) U.S. Cl. ..... 222/325; 222/181.1

(58) Field of Classification Search ..... 222/214, 222/325, 80, 108, 173, 109, 197, 153.09, 222/180, 181.1, 181.2, 181.3
See application file for complete search history.

(56) References Cited

U.S. PATENT DOCUMENTS

| | | | |
|---|---|---|---|
| D124,199 | S | 12/1940 | Petzold |
| 2,932,431 | A | 4/1960 | Lipton |
| 3,459,343 | A | 8/1969 | Rasmussen |
| 3,768,704 | A | 10/1973 | Beguin |
| 3,926,347 | A | 12/1975 | Low et al. |
| 3,952,924 | A | 4/1976 | Benson |
| 4,018,363 | A | 4/1977 | Cassia |
| 4,036,406 | A | 7/1977 | Jespersen et al. |
| D246,338 | S | 11/1977 | Jespersen |
| 4,149,573 | A | 4/1979 | Cassia |
| 4,151,867 | A | 5/1979 | Wilhere |
| 4,164,306 | A | 8/1979 | Perrin |
| 4,168,020 | A | 9/1979 | Benson |
| 4,238,056 | A | 12/1980 | Tucker et al. |
| 4,256,242 | A | 3/1981 | Christine |
| 4,324,348 | A | 4/1982 | Johnson et al. |
| 4,330,071 | A | 5/1982 | Ohlson |
| 4,345,627 | A | 8/1982 | Cassia |

(Continued)

FOREIGN PATENT DOCUMENTS

| | | |
|---|---|---|
| CA | 2153232 | 7/1994 |

(Continued)

OTHER PUBLICATIONS

Ophardt et al., *Liquid Dispenser for Dispensing Foam.*

(Continued)

*Primary Examiner*—Lien M. Ngo
(74) *Attorney, Agent, or Firm*—Wood, Herron & Evans, L.L.P.

(57) ABSTRACT

There is provided a dispensing apparatus having a liquid container located therein which is provided with a valve assembly having a foam pump and an actuator for actuating the foam pump in which the housing includes a cover pivotally attached to a backing plate. The cover is movable from a fully open position in which the container may be inserted therein to a closed position. A housing adaptor is attached to a projection on the interior surface of the cover and engages the actuator. The housing adaptor is configured so that as the cover is moved in a first direction from a non-dispensing position in which no liquid is dispensed from the container to an dispensing position, the actuator moves in a second direction to actuate the foam pump and dispense foam from the container.

28 Claims, 4 Drawing Sheets

U.S. PATENT DOCUMENTS 4,349,133 A 9/1982 Christine
4,360,130 A 11/1982 Nishimura et al.
4,391,308 A 7/1983 Steiner
4,391,309 A 7/1983 Steiner
4,394,938 A 7/1983 Frassanito
4,429,812 A 2/1984 Steiner et al.
4,437,585 A 3/1984 Banks
4,452,379 A 6/1984 Bundschuh
4,463,876 A 8/1984 Swallert
D276,294 S 11/1984 Banks
4,493,440 A 1/1985 von Buelow et al.
4,515,294 A 5/1985 Udall
4,564,127 A 1/1986 Garabedian et al.
4,570,827 A 2/1986 Roggenburg, Jr. et al.
4,573,612 A 3/1986 Maddison et al.
4,621,749 A 11/1986 Kanfer
4,634,022 A 1/1987 O'Halloran et al.
RE32,354 E 2/1987 Savage
4,651,904 A 3/1987 Schuckmann
4,667,854 A 5/1987 McDermott et al.
4,673,109 A 6/1987 Cassia
4,678,106 A 7/1987 Newell et al.
4,741,461 A 5/1988 Williamson et al.
4,778,085 A 10/1988 Bush et al.
4,828,150 A 5/1989 Bottger et al.
D302,916 S 8/1989 Williamson
4,874,023 A 10/1989 Ulm
4,932,562 A 6/1990 Christine
4,932,624 A 6/1990 Holm
4,949,877 A 8/1990 Hanna et al.
4,953,758 A 9/1990 Passalacqua
D312,184 S 11/1990 De Luca et al.
4,991,635 A 2/1991 Ulm
5,000,350 A 3/1991 Thomsen
5,016,779 A 5/1991 Williamson
5,031,676 A 7/1991 Ulm
5,033,657 A 7/1991 Whittington
5,067,635 A 11/1991 Thomsen
D322,028 S 12/1991 Appleby et al.
5,105,984 A 4/1992 Kazimir
5,108,007 A 4/1992 Smith et al.
5,121,778 A 6/1992 Baker et al.
5,178,300 A 1/1993 Haviv et al.
5,207,250 A 5/1993 Tsao
D337,908 S 8/1993 Weber
D338,585 S 8/1993 Bell et al.
5,242,083 A 9/1993 Christine et al.
5,273,083 A 12/1993 Burrows
5,320,256 A 6/1994 Wood
5,377,871 A 1/1995 Banks et al.
5,398,845 A 3/1995 Meyer
D358,288 S 5/1995 Daansen
5,439,140 A 8/1995 Meyer
5,443,236 A 8/1995 Bell et al.
5,465,877 A 11/1995 Bell et al.
5,492,247 A 2/1996 Shu et al.
5,544,788 A 8/1996 Meyer
5,556,005 A 9/1996 Banks
5,638,989 A 6/1997 Ophardt et al.
5,638,994 A 6/1997 Libit et al.
D387,597 S 12/1997 Kearnes
D392,136 S 3/1998 Ross et al.
D392,137 S 3/1998 Vignot
5,791,525 A 8/1998 Fan
5,810,204 A 9/1998 Devlin et al.
5,826,755 A 10/1998 Burd
5,855,302 A 1/1999 Fisscher
5,862,956 A 1/1999 Brandenburg et al.
5,906,299 A 5/1999 Hagleitner
5,971,223 A 10/1999 Fisscher
D417,111 S 11/1999 Polan
6,016,936 A 1/2000 Fan
6,053,360 A 4/2000 Rutter
6,053,370 A 4/2000 Ludbrook et al.
D426,094 S 6/2000 Carlson
6,082,586 A 7/2000 Banks
D431,404 S 10/2000 Brazis et al.
6,152,330 A 11/2000 Polan
6,189,740 B1 2/2001 Wade et al.
6,216,916 B1 4/2001 Maddox et al.
6,247,621 B1 6/2001 Lewis
D449,753 S 10/2001 DeKoning et al.
6,305,580 B1 10/2001 Chen
6,325,245 B1 12/2001 Matthews
D454,741 S 3/2002 Lewis et al.
6,364,170 B1 4/2002 Anderson et al.
6,409,050 B1 6/2002 Ophardt et al.
D461,671 S 8/2002 Lewis et al.
D461,984 S 8/2002 Lewis et al.
6,427,875 B1 8/2002 Hoang et al.
D462,218 S 9/2002 DeKoning et al.
D464,514 S 10/2002 Lewis et al.
6,516,976 B2 2/2003 Lewis et al.
6,530,504 B2 3/2003 Socier
D473,087 S 4/2003 Chen
6,540,110 B2 4/2003 Weiser
6,543,651 B2 4/2003 Lewis et al.
6,568,561 B2 5/2003 Studer et al.
6,575,335 B2 6/2003 Lewis et al.
6,598,765 B2 7/2003 Pagel et al.
6,601,736 B2 8/2003 Ophardt et al.
6,619,509 B2 9/2003 DeKoning et al.
6,619,512 B1 9/2003 Sayers et al.
6,626,332 B2 9/2003 Ehrensperger et al.
6,648,179 B2 11/2003 Lewis et al.
6,669,056 B2 12/2003 Bistolfi
6,695,174 B2 2/2004 Sorensen et al.

FOREIGN PATENT DOCUMENTS

WO 94/15515 7/1994

OTHER PUBLICATIONS

Schuman et al., *Foam Soap Dispenser for Push Operation*.
European Search Report; Jul. 21, 2006; 2 pages; European Patent Office.

HINGED DISPENSER HOUSING AND ADAPTOR

FIELD OF THE INVENTION

This invention relates to a hinged dispenser housing for dispensing a liquid product from a container.

BACKGROUND OF THE INVENTION

A wide variety of housing assemblies are known in the art for dispensing liquids from a variety of container configurations. Many of these housings include a lever that is pushed or pulled to dispense a liquid from the container. The hygienic requirements for dispensing various liquids differ from one environment to another. In hospitals, for example, levers that are repeatedly touched by bare hands can serve to spread germs from person to person through contact with the hands. To avoid this contamination, some dispensers include a long armlever or push bar such that the liquid can be dispensed by pressing on the end of the lever with a person's elbow or forearm, such that the hands do not contact the lever. The lever then engages a pump for dispensing a quantity of liquid.

In the hospital and other environments, it is undesirable to have a lever protruding outwardly from the container that could catch people or devices passing by. In some dispensing systems, a housing is provided having an internal actuating means that engages a wall of a pouch within the housing that contains the liquid to be dispensed. In these systems, although the protruding lever is eliminated, it is difficult to achieve complete evacuation of the contents of the liquid pouch or container and contaminating air may be drawn into the container after release of the internal actuating means. A dispenser housing operable in high hygienic demanding environments that also achieves a complete evacuation of the contents of the liquid container, prevents air from being drawn thereinto, and is not overly obtrusive was disclosed in U.S. Pat. No. 6,152,330, assigned to the assignee of this application and incorporated herein in its entirety by reference.

For various reasons in some applications, it is preferable to dispense liquids in the form of a foam. Generally, foam tends to be much easier to spread than the corresponding unfoamed liquid and in addition there is much less waste due to splashing or run-off since the foam has a much higher surface tension than the unfoamed liquid. Moreover, a foam requires less liquid to produce the same or comparable cleaning power as obtained with the unfoamed liquid due to the much higher surface area of the former. To accommodate the desires of their customers, dispenser manufacturers and suppliers typically provide two separate, non-interchangeable dispensing systems, depending on whether unfoamed liquid or foam is being dispensed. Thus if a customer wishes to change from unfoamed liquid dispensing to foam dispensing (or vice versa), the customer must purchase new dispensers and have them installed in place of the previous dispensers. In many instances, such as for example, the industrial environment, healthcare environment and other environments, the number of dispensers to replace may be large thereby making such a change overly costly and inconvenient to the customer. Additionally, from a manufacturing point of view, the different, non-interchangeable designs for foam and unfoamed liquid dispensers increases tooling costs and labor costs, which lead to an increase in overall production costs.

Accordingly, it would be advantageous to not only provide a dispenser that operates in high hygienic demanding environments, achieve substantially complete evacuation of the contents of the liquid container and prevent air from being drawn thereinto, but also provide a dispenser that may be configured to dispense an unfoamed liquid or a foam in a simple, cost effective manner.

SUMMARY OF THE INVENTION

The present invention provides a dispenser housing wherein the cover of the housing is movable and itself may be engaged in a hygienic manner and moved to dispense a liquid product, preferably a soap. This housing is operable with containers that are capable of achieving a complete evacuation of the contents, thus providing a hygienic and economic liquid soap dispensing unit. This housing is further selectively operable to dispense the product in the form of an unfoamed liquid or a foam, as desired by the user. To this end, and in accordance with the principles of the present invention, a dispenser housing is provided having a cover plate pivotally connected to a backing plate, the backing plate and cover plate together forming an enclosure or cavity within which the liquid container is located. The cover plate is movable with respect to the backing plate from an open position, in which the container may be loaded into engagement with an appropriately configured holder and unloaded therefrom, to a closed position enclosing the liquid container. In the closed position, the cover plate is pivotally movable over a limited arcuate range between an outer non-dispensing position and an inner product-dispensing position. The container includes a valve assembly having a valve and/or a foaming pump and a depressable actuator for actuating the valve and/or foaming pump. The housing further includes a projection on the interior of the cover extending into the cavity.

In one mode of operation designed to dispense a foamed liquid from a container having a vertically depressable valve actuator, a housing adaptor is coupled to the projection and engagable with the depressable valve actuator of the foaming pump. The housing adaptor is positioned and configured such that movement of the cover plate from the closed, non-dispensing position to the closed, product-dispensing position in a first, preferably horizontal direction, causes movement of the depressable valve actuator of the foaming pump in a second, preferably upwardly direction to actuate the valve of the foaming pump to dispense foamed product.

In another mode of operation the housing as herein described may be quickly modified to dispense unfoamed liquid when so desired. In particular, the housing adaptor may be removed from the cover plate to expose the rounded tip projection. A container is located within the housing having a valve assembly with a bulb-type pressure valve and a depressable valve actuator that is actuatable by movement of the actuator in the horizontal direction. The projection is positioned and configured such that movement of the cover plate from the closed, non-dispensing position to the closed, product-dispensing position in a first, preferably horizontal direction, causes movement of the depressable valve actuator of the bulb-type pressure valve in the first, preferably horizontal direction to actuate the valve to dispense unfoamed product.

In accordance with a preferred embodiment of the invention, the housing adaptor includes an outer mounting base having an opening adapted to receive therein the housing-mounted projection (which in the unfoamed liquid dispensing mode depresses the valve actuator to dispense unfoamed liquid when the cover is urged toward the base), to secure the housing adaptor to the cover plate. The housing adaptor further includes a member having a central portion coupled to the mounting base and two spaced apart parallel legs extending into the cavity toward the depressable actuator for the foam pump. The legs each having angled outer edges. The angled edges collectively define a cam surface. The vertically upwardly depressable valve actuator of the foaming pump is provided with two horizontally extending tabs that define cam follows. As the cover plate is moved toward the backing plate in a generally horizontal direction, the outer cam edges of the housing adaptor move toward the two horizontally extending cam follower tabs causing the depressable valve actuator of the foaming pump to move in an upwardly direction, thereby actuating the valve of the foaming pump to dispense foamed product therefrom.

The present invention is advantageous in that the dispenser housing disclosed and claimed in U.S. Pat. No. 6,152,330, used to enclose a liquid container and actuate a horizontally moveable valve actuator to dispense unfoamed liquid from the container, may also be used in combination with a housing adaptor selectively mounted on the housing and a dispensing valve adaptor mounted to a vertically moveable valve actuator of a foam pump, to actuate the foam pump valve actuator when the cover is moved toward the backing plate, to dispense foam from a container mounted in the housing.

These and other objects, features and advantages of the present invention shall become more apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
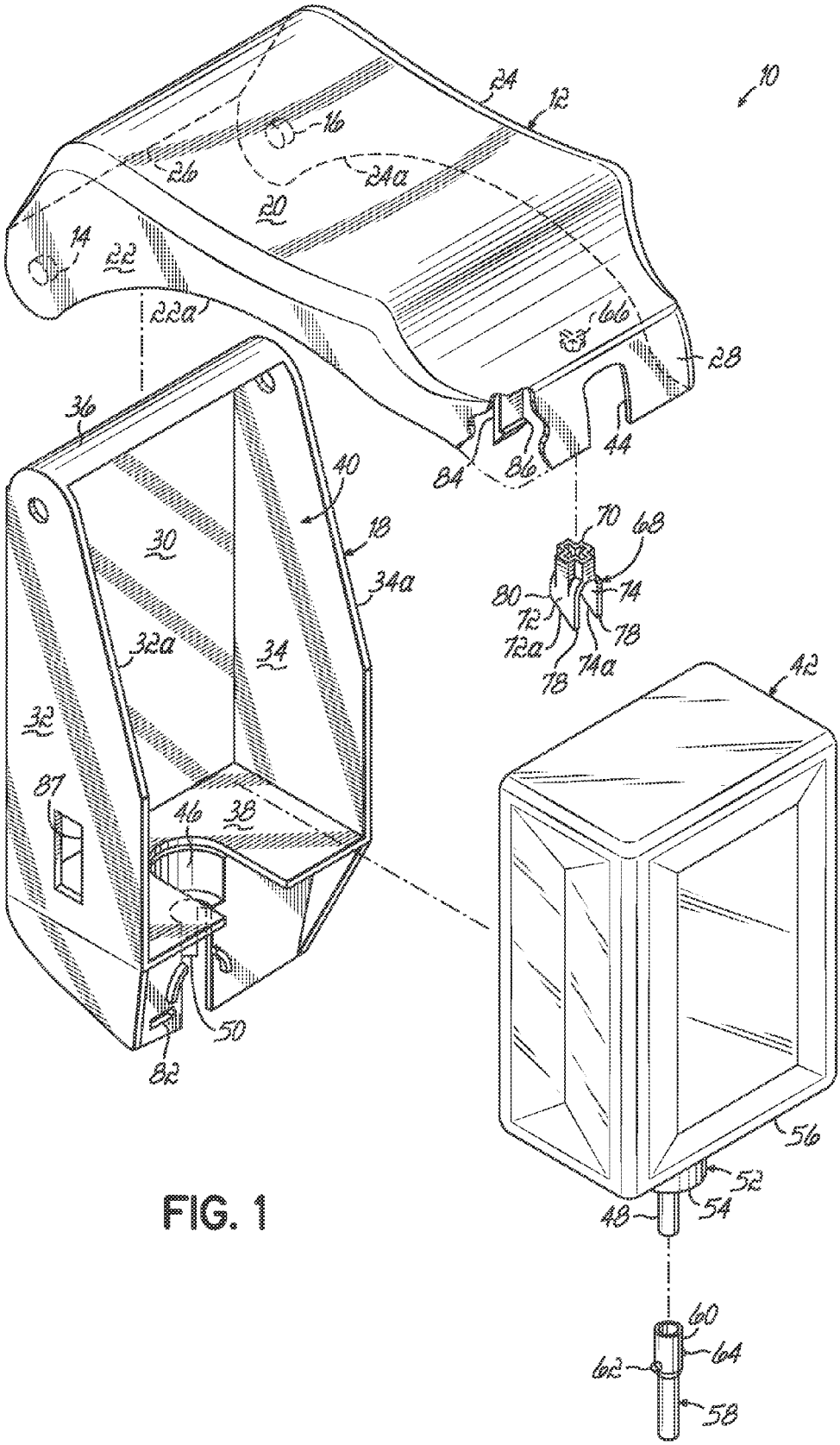
FIG. 1 is a perspective view of a preferred embodiment of the hinged dispenser housing of the present invention with the cover in the open, loading position, with the liquid container located in an external position prior to insertion into the housing interior.
Figure 2:
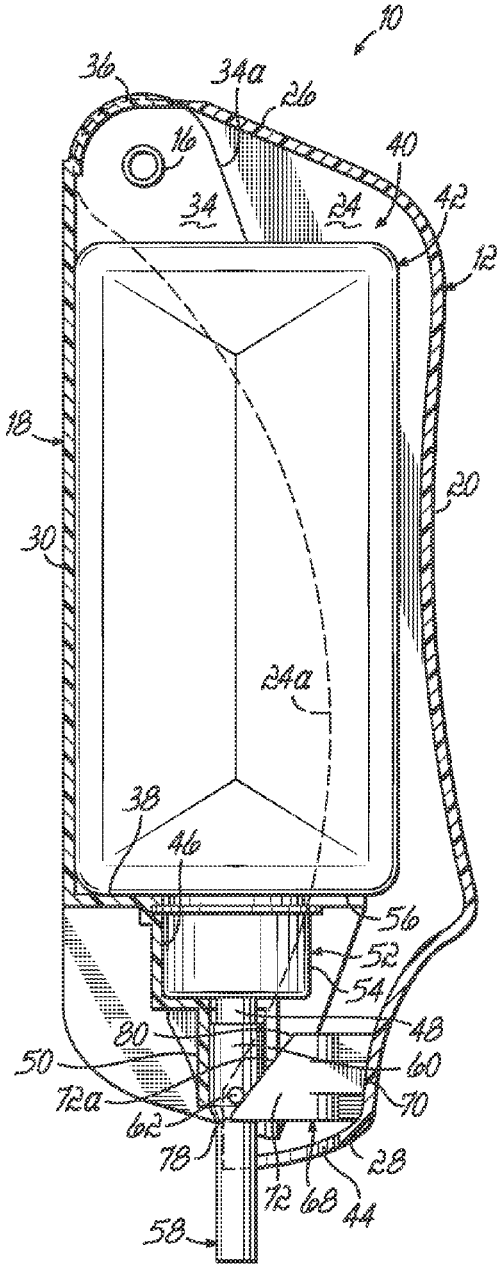
FIG. 2 is a cross-sectional side view of the hinged dispenser housing of the preferred embodiment of the invention in the closed, non-dispensing position having a container held therein.
Figure 3:
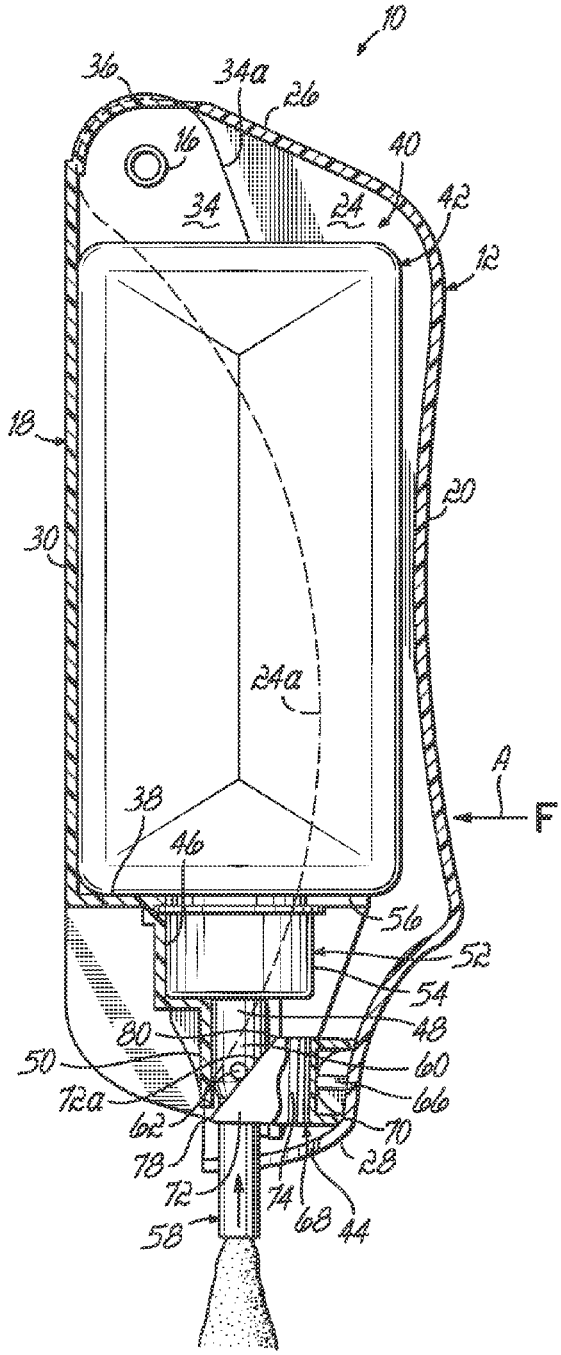
FIG. 3 is a cross-sectional side view of a hinged dispenser housing of the preferred embodiment of the invention in the closed, product-dispensing position.

Referring to FIG. 1, the dispenser housing 10 of the present invention has a cover plate 12 pivotally connected via hinge pins 14,16 to a backing plate 18 along a top end thereof. The cover plate 12 has a vertical front panel 20, two vertical side panels 22, 24 disposed generally perpendicular to the front panel 20, a generally horizontal top panel 26, and a generally horizontal bottom panel 28 extending from the lower edge of the front panel 20. The backing plate 18 has a vertical back panel 30, which may be mounted to a wall or other vertical surface, two vertical side panels 32, 34 disposed generally perpendicular to back panel 30, a curved top panel 36 and a generally horizontal bottom panel 38. The top panel 26 of the cover plate 12 fits over the top panel 36 of the backing plate 18 such that upon opening and closing of the cover plate 12, the top panel 26 of the cover plate 12 slides over the top panel 36 of the backing plate 18 without mechanical interference. The side panels 22 and 24 of the cover plate 12 have rear edges 22*a* and 24*a*, respectively. The side panels 32 and 34 of the backing plate 18 have forward edges 32*a* and 34*a*, respectively. The side panels 22 and 24 of the cover plate 12 fit over and slightly overlap the side panels 32 and 34 of the backing plate 18, as shown in FIGS. 2 and 3, or they may substantially overlap, as desired. The bottom panel 28 of the cover plate 18 extends below the bottom panel 38 of the backing panel 18, as shown in FIGS. 2 and 3.

The cover plate 12 and backing plate 18 together form a generally rectangular chamber or cavity 40 in which a generally rectangular liquid container 42 is held. The container 42 is placed in an inverted position inside the cavity 40, with the bottom panel 38 of the backing plate 18 supporting the shoulders 56 of the container 42. Cut-outs 44 and 46 are provided in the bottom panels 28 and 38, respectively, of the cover and backing plates 12 and 18, respectively, such that a generally tubular liquid-dispensing tube 48 integral with container 42 or connected thereto may extend from the container 42 through the bottom of the dispenser housing 10 for the convenient dispensing of unfoamed liquid or foam to a user. The bottom panel 38 of the backing plate 18 may further comprise a generally downwardly extending support flange 50 connected to the underside of the bottom panel 38 adjacent cut-out 46 for supporting the dispensing tube 48.

A valve assembly 52 couples to container 42 and includes a generally cylindrical foaming pump 54 having an integral valve element (not shown) that combines air and liquid from container 42 to dispense foam from the outlet end of the dispensing tube 48. It is to be understood that valve assembly 52 may generally comprise a valve element and/or a pump or a pump having an integral valve, as illustrated in FIG. 1. Foaming pump 54 is preferably actuated by movement of a depressable valve actuator, such as dispensing tube 48. For example, foaming pump 54 may be actuated by moving dispensing tube 48 in a generally upwardly direction when the container 42 is disposed in cavity 40. The upper end of the valve assembly 52 is preferably internally threaded and connects to an externally threaded tube extending from the container 42. The dispensing tube 48 is integral with the body of the valve assembly 52. For example, one such valve assembly 52 having a foaming pump and integral valve element may be made according to the disclosure of U.S. Pat. No. 6,053,364, and sold commercially by Airspray NV, Alkmaar, Netherlands and incorporated herein in its entirety by reference. The dispensing tube 48, when depressed, operates to aerate the liquid in container 42 and dispense a quantity of foam while preventing the back flow of air into container 42, thereby preventing contamination of the liquid contents and allowing complete evacuation of the container as the container collapses, as described in U.S. Pat.

No. 6,158,620, assigned to the assignee of this application and incorporated herein in its entirety by reference.

As shown in FIGS. 1-3, a dispensing adaptor 58 is coupled to the dispensing tube 48 of valve assembly 52. The dispensing adaptor 58 may comprise a generally cylindrical tube having a connecting portion 60 slightly larger than the dispensing tube 48 such that the dispensing adaptor 58 slidably engages dispensing tube 48 and is secured thereto by a fictional fit. For reasons which will become apparent below, the dispensing adaptor 58 further includes a pair of opposed horizontally-oriented tabs 62, 64 on the outer surface of the adaptor 58 that define cam followers for moving the dispensing adaptor 58 and actuating the foaming pump 54. As will be recognized by those having ordinary skill in the art, the dispensing adaptor 58 may be formed integral with the body of the valve assembly 52 or be provided as a separate piece as shown.

In accordance with the principles of the invention, and as shown in FIGS. 1-3, the cover plate 12 of the dispenser housing 10 is provided with a connecting member comprising a projection 66 on the inner surface of the front panel 20 that extends into the cavity 40. The projection 66 preferably comprises two arcuately shaped cross members that are substantially perpendicular to each other and include a rounded tip at their intersection. The connecting member further includes a housing adaptor 68 which may be coupled, and preferably removably coupled, to projection 66. To this end, housing adaptor 68 includes a mounting base 70 having an opening at one end configured to receive projection 66 therein and secure housing adaptor 68 to cover plate 12 through a frictional fit. The opposite end of the base 70 includes a member having a central portion coupled to base 70 and a pair of generally parallel spaced-apart leg portions 72, 74 extending into cavity 40 and open at a distal end thereof. The open end of the leg portions 72, 74 include angled outer edges 72*a* and 74*a* respectively. The edges 72*a*, 74*a* have a lower end 78 spaced from the base 70 by a distance greater than the distance between the base 70 and the upper end 80 of edges 72*a*, 74*a*. As will be described in more detail below, outer edges 72*a*, 74*a* define a cam surface angled in an upward direction from the lower end 78 to the upper end 80. The housing adaptor 68 is secured to projection 66 so that the angled edges 72*a* and 74*a* face the cavity 40 and the lower end 78 is adjacent the bottom panel 28 of the cover plate 12. The tabs 62, 64 on the dispensing adaptor 58 are configured to engage the angled outer edges 72*a* and 74*a* so that when the cover plate 12 is moved in a generally horizontal direction toward the backing plate 18 to its product-dispensing position, the dispensing adaptor 58, and thus the dispensing tube 48 is moved in the upwardly vertical direction actuating the foaming pump 54 to dispense foam from an outlet end of the dispensing adaptor 58.

The cover plate 12 is movable from an open, container-loading position, as shown in FIG. 1, to a closed, non-dispensing position, as shown in FIG. 2, and to a closed, product-dispensing position, as shown in FIG. 3. In the open, container-loading position, a container 42 of liquid may be inserted into the cavity 40 in the inverted position, so as to rest on the bottom panel 38 of the backing plate 18. The cavity 40 of dispenser housing 10 is adapted to house a collapsible container, preferably of the type described in U.S. Pat. No. 6,158,620. As shown in FIG. 2, the cover plate 12 may then be closed to its non-dispensing position where the outer edges 72*a* and 74*a* of housing adaptor 68 align with and engage the tabs 62, 64 on the dispensing adaptor 58. The tabs 62, 64 are positioned adjacent the lower end 78 of the housing adaptor 68. Upon a force F being applied in a generally horizontal direction to the outer surface of the front panel 20 of the cover plate 12 in the direction of arrow A, as shown in FIG. 3, the dispensing adaptor 58 moves in a generally upwardly vertical direction as tabs 62, 64 move along edges 72*a*, 74*a* of housing adaptor 68. This vertical movement of dispensing adaptor 58 moves the dispensing tube 48 thereby actuating foaming pump 54 so as to dispense foam from the outlet end of dispensing adaptor 58. Due to the spring-biased nature of the foaming pump actuator, upon release of the force F applied to the front panel 20, the tabs 62, 64 on dispenser adaptor 58 move back along edges 72*a*, 74*a* and cause cover plate 12 to return to its non-dispensing position (FIG. 2).

The cover plate 12 and backing plate 18 may further comprise a releasable latching device for releasably latching the cover plate 12 in the closed position. As shown in FIG. 1, the backing plate 18 is provided with a slot 82 and the cover plate 12 is provided with a tab 84 fixedly mounted to the interior of the cover panel 12, such as along bottom panel 28 or panel 30, so that upon closing of the cover plate 12, the tab 84 is inserted through the slot 82 in the backing plate 18. A protrusion 86 on the end of tab 84 allows it to hold the cover plate 12 in the closed position. It is to be understood, however, that any other latching device known to one skilled in the art may be provided for use with the dispenser housing 10 of the present invention. The latching device should, however, enable movement in the closed, latched position between the outer non-dispensing position and the inner product-dispensing position.

The dispenser housing 10 of the invention may be further provided with a cut-out 87 in one or both side panels 32, 34 of the backing plate 18, and in the side panels 22, 24 of the cover plate 12 if necessary, to provide visual access to the liquid container 42 for determining the amount of liquid remaining in the container 42. If the side panels of the cover plate 12 and backing plate 18 only overlap slightly, the cut-out 87 will only be necessary in the side panels 32, 34 of the backing plate 18. If the side panels 22, 24 of the cover plate 12 substantially overlap the side panels 32, 34 of the backing plate 18, such that the cut-out 87 in the side panel of the backing plate is visually obscured, then the cut-out 87 will also be needed in the side panels 22, 24 of the cover plate 12. The cut-out 87 in the side panel 32, as shown in FIGS. 1 and 2, is advantageously located in close proximity to the bottom panel 38 of the backing plate 18 on which the container 42 rests.

In use, the cover plate 12 of the dispenser housing 10 is pivoted upwardly to provide access to the cavity 40 within the dispenser housing 10. The container 42 of a liquid is inserted into the cavity 40 in the inverted position with the shoulders 56 of the container 42 resting on the bottom panel 38 of the backing plate 18 and the dispenser tube 48 with valve assembly 52 extending below the bottom panel 38 through cut-out 46. The dispensing adaptor 58 may be secured to dispensing tube 48 prior to inserting container 42 in cavity 40 so that the tabs 62, 64 extend generally in a lateral direction. The outlet end of dispensing adaptor 58 typically extends below bottom panel 28 in cover plate 12. With the cover plate 12 in the open position, the housing adaptor 68 may be attached to projection 66 by engaging the opening in base 70 over projection 66 so that the bottom end 78 of the outer edges 72*a*, 74*a* is adjacent bottom panel 28. The cover plate 12 is pivoted downwardly and latched into the backing plate 14 by the interaction of latching tab 84 and slot 82 to releasably latch the cover plate 12 in a closed position. The cam surface defined by outer angled edges 72*a*, 74*a* on the housing adaptor 68 engage the cam followers defined by tabs 62, 64 on the dispensing adaptor 58. Force F in the direction of arrow A (FIG. 3) may then be applied to the cover plate 12 such that as the angled edges 72*a*, 74*a* move relative to tabs 62, 64, the dispensing adaptor 58 is moved in the upward direction to actuate the foaming pump 54 to dispense foam from the outlet end of the dispensing adaptor 58 and into a person's hand located below. Force applied to the cover plate 12 is then released, which then returns the cover plate 12 to a non-dispensing position due to the spring-biased nature of the foaming pump actuator. Force may be applied to the cover plate 12 by the user's hand, elbow, forearm, shoulder, or any other convenient means to provide the desired degree of hygiene as the particular situation requires. This dispensing action may be repeated until there has been a substantially complete evacuation of the liquid contents of the container 42. There is thus provided an unobtrusive dispenser housing for dispensing liquid products as a foam that may be used in high-hygienic applications with little or no waste of the liquid product, and which hides and protects the liquid container 42.

Figure 4A:
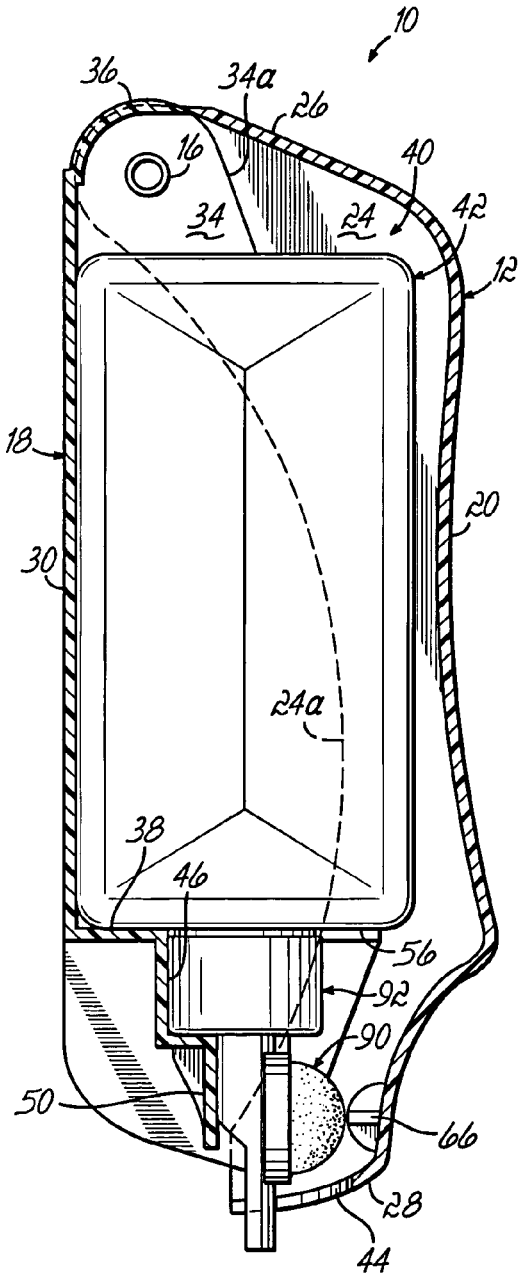
FIGS. 4A and 4B depict the hinged dispenser housing of this invention with the housing adaptor removed, used for dispensing unfoamed liquid from a container located within the housing having a horizontally depressable valve actuator.
Figure 4B:
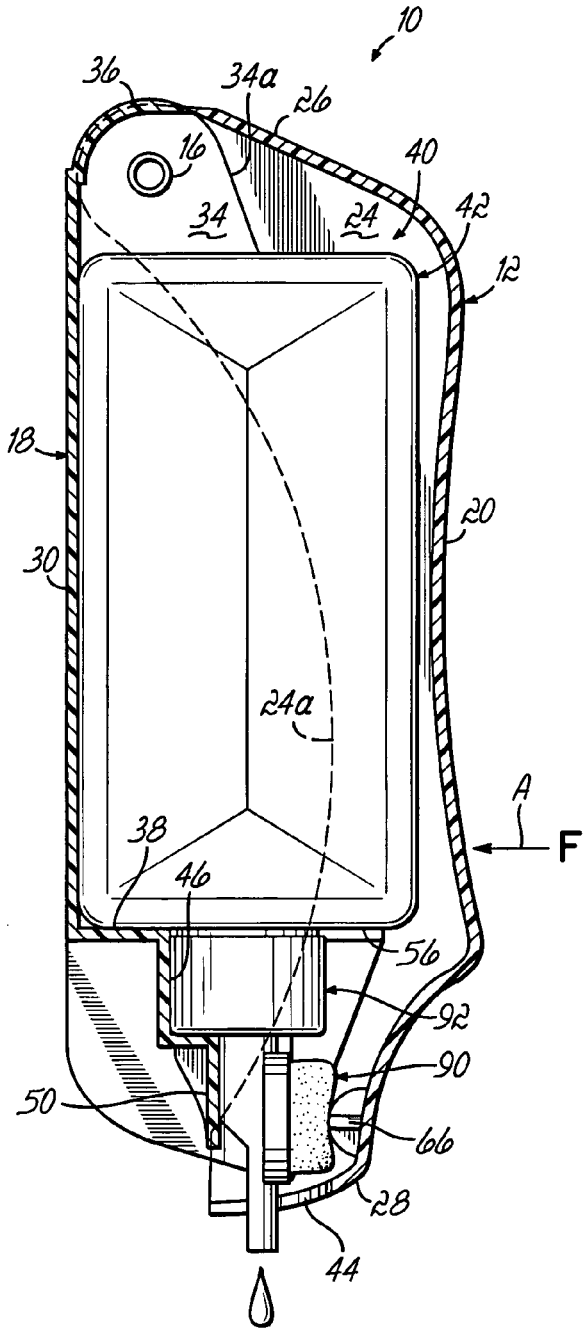

The dispenser housing 10 of the invention may be advantageously configured to dispense either unfoamed liquid or foam. Moreover, converting the dispenser from foam dispensing to liquid dispensing (or vice versa) may be accomplished in a convenient, cost-effective manner. In particular, to convert from foam dispensing to liquid dispensing, a user would simply remove the housing adaptor 68 to expose the rounded tip projection 66 on the inside of the front panel 20. Additionally, the user would remove the container 42 having the valve assembly 52 incorporating foaming pump 54 and replace it with a container having a valve assembly with a depressable bulb-type pressure valve, such as that fully disclosed in U.S. Pat. No. 6,152,330. As disclosed in that patent, and with reference to FIGS. 4A and 4B, the projection 66 on the inside surface of front cover 20 is positioned and configured to engage a depressable valve actuator 90 of a valve 92 which is coupled to container 42. The depressable valve actuator 90 is configured to be moveable in the horizontal direction in order to actuate valve 92 and dispense liquid from container 42. Thus when a force F is applied in the direction of arrow A (FIG. 4B), the front cover moves in the horizontal direction causing projection 66 to engage and depress the depressable valve actuator 90 in the horizontal direction to actuate valve 92 to dispense unfoamed liquid from the container. It should also be recognized that instead of replacing container 42, the same container may be used but the valve assembly changed so as to have a depressable valve actuator according to the type of dispensing desired.

Figure 5:
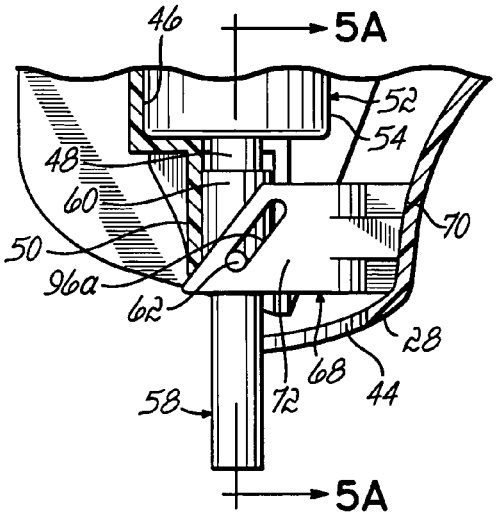
FIGS. 5 and 5A depict an alternate embodiment of the housing adaptor having a pair of angled slots to define the cam surface.
Figure 6:
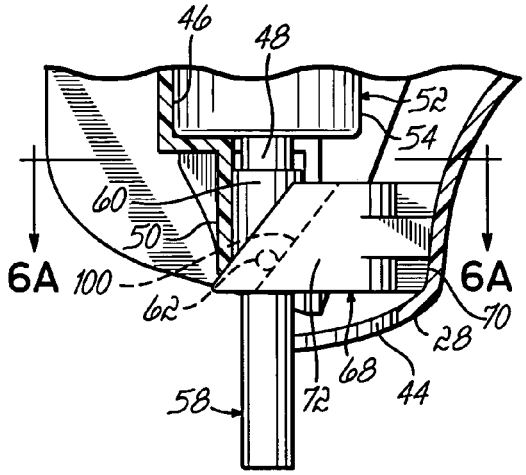
FIGS. 6 and 6A depict another alternate embodiment of the housing adaptor having a pair of angled ribs to define the cam surface.
Figure 5A:
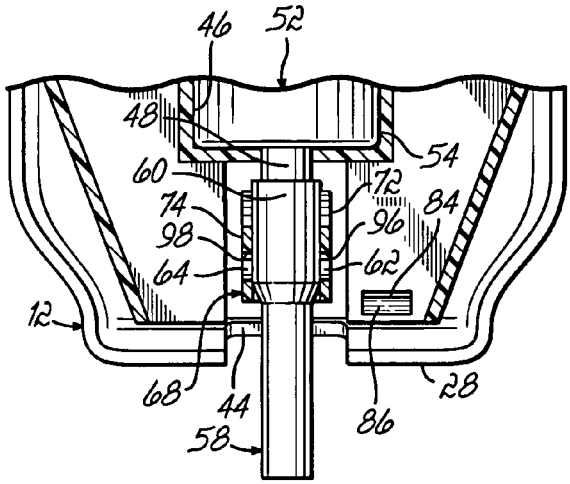
Figure 6A:
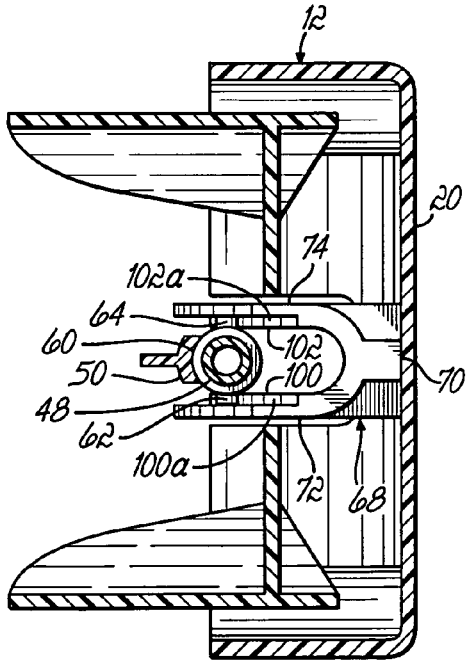

While the present invention has been described and illustrated in connection with a preferred embodiment thereof, and while the preferred embodiment has been described in considerable detail, it is not intended to restrict or in any way limit the scope of the appended claims to such details. For example, while the housing adaptor 68 is shown and described as having a cam surface defined by the outer edges 72*a*, 74*a* of leg portions 72, 74 respectively, those having skill in the art will recognize additional embodiments within the scope of the present invention. For instance, as shown in FIGS. 5 and 5A instead of the cam follows 62, 64 engaging the outer edge 72*a*, 74*a* of the leg portions 72, 74, leg portions 72, 74 may include a pair of angled slots 96, 98 adapted to receive tabs 62, 64 therein and defining cam surfaces 96*a*, 98*a*. Alternately, and as shown in FIGS. 6 and 6A, leg portions 72, 74 may include a pair of angled ribs 100, 102 interior to the leg portions 72, 74 and defining cam surfaces 100*a* and 102*a* along the top surface of the ribs 100, 102. In both of these alternate embodiments, the cam surfaces 96*a*, 98*a* or 100*a*, 102*a* engage the tabs 62, 64 to move the depressable actuator in the vertical direction to actuate the foam pump 54 and dispense foam therefrom. Moreover, those of ordinary skill in the art will further recognize that the dispenser housing, while shown and described as being mounted to a vertical wall, may be configured to mount to non-vertical support members. The invention in its broader aspects is therefore not limited to the specific details, representative apparatus and method, and illustrative examples shown and described. Accordingly, departures may be made from such details without departing from the scope or spirit of applicant's general inventive concept.

What is claimed is:

1. A dispensing apparatus for dispensing a product from a container located therein which is provided with a valve assembly having a valve and a depressable actuator for actuating the valve, comprising:

a housing having a backing plate and a cover plate pivotally connected to said backing plate, said cover plate being moveable with respect to said backing plate from an open, container-loading position to a closed, non-dispensing position and to a closed, product-dispensing position, said cover plate and said backing plate together forming a cavity adapted to enclose and hold the container;

an opening in a bottom portion of said housing through which the product is dispensable; and a connecting member attached to an inner surface of said cover plate and extending into said cavity formed by said cover plate and said backing plate so as to engage the depressable actuator, said connecting member positioned and configured so that movement of said cover plate from the closed, non-dispensing position to the closed, product-dispensing position in a first generally horizontal direction causes movement of the depressable actuator in a second generally vertically upward direction to actuate the valve and dispense product from said opening, wherein said connecting member includes a cam surface and the depressable actuator includes a cam follower, said cam surface and the cam follower cooperating such that said cam surface engages the cam follower to move the depressable actuator in the second direction when said cover plate is moved in the first direction.

2. The apparatus of claim 1, wherein said connecting member comprises:

a base having one end fixedly attached to said inner surface of said cover plate; and a pair of spaced apart leg portions extending from said base and into said cavity, each of said leg portions having at least one angled cam surface, said cam surface having a lower end and an upper end, said lower end spaced from said base by a distance greater than the distance between said base and said upper end;

wherein the cam follower is adjacent said lower end when said cover plate is in the closed, non-dispensing position and is adjacent said upper end when said cover plate is in the closed, product-dispensing position.

3. The apparatus of claim 2, wherein each of said leg portions includes an angled outer edge defining said cam surface.

4. A dispensing apparatus for dispensing a foamed product comprising:

a container enclosing a product to be dispensed;

a valve assembly comprising a foaming pump, said valve assembly having an inlet in fluid communication with said container, an outlet and a depressable actuator adapted to actuate said foaming pump to dispense the foamed product through said outlet;

a housing comprising a backing plate and a cover plate pivotally connected to said backing plate, said cover plate and said backing plate together forming a cavity adapted to hold said container, and said cover plate being movable with respect to said backing plate from an open, container-loading position to a closed, non-dispensing position and to a closed, product-dispensing position; and a connecting member attached to an inner surface of said cover plate and extending into said cavity formed by said cover plate and said backing plate so as to engage said depressable actuator, said connecting member positioned and configured so that movement of said cover plate from the closed, non-dispensing position to the closed, product-dispensing position in a first direction causes movement of the depressable actuator in a second direction, substantially different from the first direction, to actuate the foaming pump and dispense the foamed product through said outlet of said valve assembly, wherein said connecting member includes a cam surface and the depressable actuator includes a cam follower, said cam surface and the cam follower coorerating such that said cam surface engages the cam follower to move the depressable actuator in the second direction when said cover plate is moved in the first direction.

5. The apparatus of claim 4, wherein the first and second directions are generally perpendicular to each other.

6. The apparatus of claim 5, wherein the first and second directions are generally horizontal and vertically upward, respectively.

7. The apparatus of claim 4, wherein said connecting member comprises:

a base having one end fixedly attached to said inner surface of said cover plate; and a pair of spaced apart leg portions extending from said base and into said cavity, each of said leg portions having at least one angled cam surface, said cam surface having a lower end and an upper end, said lower end spaced from said base by a distance greater than the distance between said base and said upper end;

wherein said cam follower is adjacent said lower end when said cover plate is in the closed, non-dispensing position and is adjacent said upper end when said cover plate is in the closed, product-dispensing position.

8. The apparatus of claim 7, wherein each of said leg portions includes an angled outer edge defining said cam surface.

9. The apparatus of claim 4, wherein said valve assembly includes a dispensing adaptor coupled to said depressable actuator, said dispensing adaptor including at least one cam follower.

10. The apparatus of claim 9, wherein said dispensing adaptor includes a pair of opposed tabs extending from an exterior surface there of to define said cam follower.

11. The apparatus of claim 9 wherein said dispensing adaptor is removably coupled to said depressable actuator.

12. A dispensing apparatus for dispensing a product from a container located therein which is provided with a valve assembly having a valve and a depressable actuator for actuating the valve, comprising:

a housing having a backing plate and a cover plate pivotally connected to said backing plate, said cover plate being moveable with respect to said backing plate from an open, container-loading position to a closed, non-dispensing position and to a closed, product-dispensing position, said cover plate and said backing plate together forming a cavity adapted to enclose and hold the container;

an opening in a bottom portion of said housing through which the product is dispensable;

a projection on an inner surface of said cover plate and extending into said cavity formed by said cover plate and said backing plate; and a housing adaptor removably coupled to said projection and engaging the depressable actuator, said housing adaptor being so positioned and configured such that movement of said cover plate from the closed, non-dispensing position to the closed, product-dispensing position in a first direction causes movement of the depressable actuator in a second direction, substantially different from the first direction, to actuate the valve and dispense product from said opening, wherein said housing adaptor includes a cam surface and the depressable actuator includes a cam follower, said cam surface and the cam follower coorerating such that said cam surface engages the cam follower to move the depressable actuator in the second direction when said cover plate is moved in the first direction.

13. The apparatus of claim 12, wherein the first and second directions are generally perpendicular to each other.

14. The apparatus of claim 13, wherein the first and second directions are generally horizontal and vertically upward, respectively.

15. The apparatus of claim 12, wherein said housing adaptor comprises:

a base having an opening adapted to receive said projection and secure said housing adaptor to said cover plate; and a pair of spaced apart leg portions extending from said base and into said cavity, each of said leg portions having at least one angled cam surface, said cam surface having a lower end and an upper end, said lower end spaced from said base by a distance greater than the distance between said base and said upper end;

wherein the cam follower is adjacent said lower end when said cover plate is in the closed, non-dispensing position and is adjacent said upper end when said cover plate is in the closed, product-dispensing position.

16. The apparatus of claim 15, wherein each of said leg portions includes an angled outer edge defining said cam surface.

17. The apparatus of claim 12, wherein when said housing adaptor is removed, said projection is positioned and configured such that movement of said cover plate from the closed, non-dispensing position to the closed, product-dispensing position in a first direction causes movement of a depressable actuator of a container located in said housing in said first direction to dispense product therefrom.

18. A dispensing apparatus for dispensing a foamed product comprising:

a container enclosing a product to be dispensed;

a valve assembly comprising a foaming pump, said valve assembly having an inlet in fluid communication with said container, an outlet and a depressable actuator adapted to actuate said foaming pump to dispense the foamed product through said outlet;

a housing comprising a backing plate and a cover plate pivotally connected to said backing plate, said cover plate and said backing plate together forming a cavity adapted to hold said container, and said cover plate being movable with respect to said backing plate from an open, container-loading position to a closed, non-dispensing position and to a closed, product-dispensing position;

a projection on an inner surface of said cover plate and extending into said cavity formed by said cover plate and said backing plate; and a housing adaptor coupled to said projection and engaging said depressable actuator, said housing adaptor being so positioned and configured such that movement of said cover plate from the closed, non-dispensing position to the closed, product-dispensing position in a first direction causes movement of said depressable actuator in a second direction, substantially different from the first direction, to actuate said foaming pump and dispense the foamed product through said outlet of said valve assembly, wherein said housing adaptor includes a cam surface and the depressable actuator includes a cam follower, said cam surface and the cam follower coorerating such that said cam surface engages the cam follower to move the depressable actuator in the second direction when said cover plate is moved in the first direction.

19. The apparatus of claim 18, wherein the first and second directions are generally perpendicular to each other.

20. The apparatus of claim 19, wherein the first and second directions are generally horizontal and vertically upward, respectively.

21. The apparatus of claim 18, wherein said housing adaptor comprises:

a base having an opening adapted to receive said projection and secure said housing adaptor to said cover plate; and a pair of spaced apart leg portions extending from said base and into said cavity, each of said leg portions having at least one angled cam surface, said cam surface having a lower end and an upper end, said lower end spaced from said base by a distance greater than the distance between said base and said upper end;

wherein the cam follower is adjacent said lower end when said cover plate is in the closed, non-dispensing position and is adjacent said upper end when said cover plate is in the closed, product-dispensing position.

22. The apparatus of claim 21, wherein each of said leg portions includes an angled outer edge defining said cam surface.

23. The apparatus of claim 18, wherein said housing adaptor is removably coupled to said projection such that when said housing adaptor is removed, said projection is positioned and configured such that movement of said cover plate from the closed, non-dispensing position to the closed, product-dispensing position in a first direction causes movement of a depressable actuator of a container located in said housing in said first direction to dispense product therefrom.

24. The apparatus of claim 18, wherein said valve assembly includes a dispensing adaptor coupled to said depressable actuator, said dispensing adaptor including at least one cam follower.

25. The apparatus of claim 24, wherein said dispensing adaptor includes a pair of opposed tabs extending from an exterior surface there of to define said cam follower.

26. The apparatus of claim 24 wherein said dispensing adaptor is removably coupled to said depressable actuator.

27. An adaptor assembly for use with a dispenser housing having a backing plate and a cover plate pivotally connected to said backing plate and moveable with respect to said backing plate in a first direction, and a container enclosing a product to be dispensed, the container including a valve assembly having a valve and a depressable actuator moveable in a second direction for actuating the valve, comprising:

a housing adaptor removably mounted on an inside surface of the cover plate and including at least one cam surface; and a dispensing adaptor removably mounted on the depressable actuator and including at least one cam follower, said cam surface and said cam follower so positioned and configured such that movement of the cover plate in the first direction causes movement of the depressable actuator in the second direction to actuate the valve and dispense foamed product.

28. A dispensing apparatus for dispensing a product in a liquid dispensing mode or a foam dispensing mode, wherein when in the liquid dispensing mode the apparatus includes a first container provided with a valve assembly having a valve and a depressible actuator for actuating the valve when moved in a first direction, and when in the foam dispensing mode the apparatus includes a second container provided with a valve assembly having a valve and a depressible actuator for actuating the valve when moved in a second direction, comprising:

a housing having a backing plate and a cover plate pivotally connected to said backing plate, said cover plate being moveable with respect to said backing plate from an open, container-loading position to a closed, non-dispensing position and to a closed, dispensing position, said cover plate and said backing plate together forming a cavity adapted to enclose and hold the first or second container;

an opening in a bottom portion of said housing through which the product is dispensable;

a projection on an inner surface of said cover plate and extending into said cavity formed by said cover plate and said backing plate, wherein when in the liquid dispensing mode said projection is positioned and configured such that movement of said cover plate from the closed, non-dispesing position to the closed, product-dispensing position in a first direction causes movement of the depressible actuator of the first container in the first direction to dispense liquid product; and a housing adaptor removably coupled to said projection, wherein when in the foam dispensing mode said housing adaptor is positioned and configured such that movement of said cover plate from the closed, non-dispensing position to the closed, product-dispensing position in the first direction causes movement of the depressable actuator of the second container in the second direction to dispense foam product.

* * * * *